US005990610A

United States Patent [19]

Matsumoto et al.

[11] Patent Number: 5,990,610

[45] Date of Patent: Nov. 23, 1999

[54] MANUFACTURING METHOD AND APPARATUS FOR INSULATING MEMBER

[75] Inventors: Shigeo Matsumoto, Mie; Takashi Setsuda, Aichi; Haruo Ito, Aichi; Kazuyuki Ota, Aichi, all of Japan

[73] Assignee: Sony Corporation, Japan

[21] Appl. No.: 08/305,283

[22] Filed: Sep. 12, 1994

[30] Foreign Application Priority Data

Sep. 21, 1993 [JP] Japan ..... 5-235122

[51] Int. Cl.[6] ..... H01J 29/82

[52] U.S. Cl. ..... 313/477 HC; 313/318.05; 313/318.06; 313/51; 439/602; 439/618; 174/50.57; 174/52.1; 174/145; 174/167; 174/137 B

[58] Field of Search ..... 313/477 HC, 318.01, 313/318.05, 318.06, 51; 439/602, 182, 618; 174/145, 152 E, 167, 174, 177, 137 B, 52.1, 52.5, 50.54, 50.57, 138 G, 138 C

[56] References Cited

U.S. PATENT DOCUMENTS

| | | | |
|---|---|---|---|
| 3,240,980 | 3/1966 | Schuster | 313/318.05 X |
| 4,040,707 | 8/1977 | Pisano | 439/618 |
| 4,040,708 | 8/1977 | Neuber et al. | 439/618 X |
| 4,155,616 | 5/1979 | Crosby et al. | 439/618 |
| 4,155,618 | 5/1979 | Regnault et al. | 439/618 |

FOREIGN PATENT DOCUMENTS

| | | | |
|---|---|---|---|
| 0014550 | 6/1980 | European Pat. Off. . | |
| 0896944 | 5/1962 | United Kingdom | 313/318.05 |
| 2132012 | 6/1984 | United Kingdom . | |

*Primary Examiner*—Ashok Patel
*Attorney, Agent, or Firm*—Rader, Fishman & Grauer; Ronald P. Kananen

[57] ABSTRACT

This invention secures the breakdown voltage between stem pins or the like for high voltage service in a cathode ray tube. This insulator is formed of a clay-like silicone compound having a tip-throughhole and pin-throughholes or a stem base with the electric insulator mounted to the stem base. An inter-stem electric insulation device is structured by mounting either one of the electric insulator or the stem base with the electric insulator to the stem of a cathode ray tube and by pressing to fix together. This structure does not allow bubble generation caused by the electric insulator, and makes the handling easy, and furthermore, allows an automatic mounting of the electric insulator to a stem.

8 Claims, 4 Drawing Sheets

MANUFACTURING METHOD AND APPARATUS FOR INSULATING MEMBER

BACKGROUND OF THE INVENTION

1. Field of the Invention

This invention relates to an electric insulator being capable of insulating between high voltage stem pins in a cathode ray tube used for electric equipment provided with high voltage electrodes, which electric equipment particularly includes color television picture tubes and monitors of image screens and computers, and for other electrodes being subjected to a high voltage, and relates to an electric insulation device used thereof, and further relates to a method of electrical insulation using the electric insulator.

2. Description of the Related Art

The cathode ray tube described above is a typical example of electric equipment provided with high voltage electrodes. The high voltage inter-stem pin electric insulator in a cathode ray tube of the prior art and the method for producing a cathode ray tube using the insulator are described below referring to FIG. 1 and FIG. 2.

FIG. 1 illustrates the method of electric insulation between stem pins including a high voltage stem pin of the prior art. FIG. 1A shows a stem base, and FIG. 1B shows a neck of the cathode ray tube. FIG. 2 illustrates the neck of the cathode ray tube structured in accordance with the method of electrical insulation illustrated in FIG. 1. FIG. 2A gives a view of the neck, and FIG. 2B gives the cross sectional view along the A—A line in FIG. 2A.

In FIG. 1B, the reference number 1 designates the neck of a cathode ray tube which is installed in a color television picture tube or a monitor for an image screen or computer. The neck accepts an electron gun being mounted on a stem 2, which is not shown, by insertion therein, and the stem 2 is provided with more than one stud electrode, stem pins 3A, 3B, 3C, etc. The glass periphery of the stem 2 and the glass edge periphery of the neck 1 are welded together to integrate them. The assembled cathode is evacuated through the tip 4 of the exhaust pipe formed at the center of the stem 2, then the tip 4 is sealed. The stem pins 3A, 3B, 3C, etc. are studded along a specified pin pitch circle.

In FIG. 1A, the reference number 10 designates a stem base. The stem base 10 consists of a bottom disc plate 11, a tip acceptor 12 which is formed at the center of the bottom disc plate 11 and protects the tip 4, an acceptor for high voltage stem pin 13 in a fan-shape to receive a high voltage stem pin 3B and act also as a part of the side wall of the tip acceptor 12, a skirt 14 which covers the edge periphery of the neck 1 formed at the periphery of the bottom plate 11 and which prevents sagging of the paste electric insulator 5, and more than one throughhole, 15A, 15B, 15C, etc. aligning to the stem pins 3A, 3B, 3B, etc. formed at the periphery of the bottom plate 11.

A common material for the stem base 10 is a resin such as polycarbonate which has excellent insulations properties. The dielectric breakdown voltage of polycarbonate resin is 30 KV/mm.

A conventional method to electrically insulate between the stem pins 3A, 3B, 3C, etc. being studded onto the stem 2 on the neck 1 of the cathode ray tube is to evacuate the cathode ray tube, to seal the tip 4, then, as illustrated in FIG. 1B, to insert the nozzle of a tube 6 filled with paste electric insulator 5 between the stem pins 3A, 3B, 3C, etc. of the stem 2, and to squeeze out a small amount of the electric insulator 5 from the tube 6 using fingers 7.

The stem base 10 shown in FIG. 1A is placed on the applied electric insulator 5 in a manner that the tip acceptor 12 accepts the tip 4 and that the acceptor 13 for high voltage stem pin 3B accepts the high voltage stem pin 3B and that each of the throughholes 15A, 15B, 15C, etc. accepts a corresponding stem pin 3A, 3B, 3C, etc. under a slight compression. Then, the configuration becomes the one illustrated in FIG. 2. The structure assures the electric insulation between the stem pins, 3A, 3B, 3C, etc.

As realized in the present color television picture tubes and monitors for image screens and computers, the cathode ray tubes for this equipments are requested to have high brightness and high resolution. To cope with the ever increasing demand, a high voltage is applied not only to the anode of the cathode ray tube but also to the electrode of the electron gun in the cathode ray tube. In particular, a focus electrode is unavoidably applied with a high voltage for improving the focusing characteristic.

The outside diameter of the neck 1 receiving the electron gun has an upper limit from the standpoint of saving the deflection power of the electron gun. Consequently, the area of stem 2 is limited. Since such a limited area of the stem 2 receives the stem pins 3A, 3B, 3C, etc., which receive various levels of voltage, the spacing of these stem pins 3A, 3B, 3C, etc. becomes close.

For example, a color cathode ray tube for monitoring a graphic display made by SONY CORP. has the pin pitch circle diameter of 15.24 mm, and the number of studded pins is 14 with the pin spacing of 3.42 mm.

Among these stem pins, 3A, 3B, 3C, etc., the stem pin 3A, for example, is called the G1 pin which is applied with a voltage of 0 to several volts, and the stem pin 3B is the one for focus electrode which is applied with maximum 9800 volts, and the stem pin 3C is the one to supply voltage to the convergence electrode and is applied with 0 to 2000 volts.

Accordingly, there exists a maximum difference of 9800 volts between the stem pin 3A and the stem pin 3B, and a maximum of 8750 volts between the stem pin 3B and the stem pin 3C. For a new cathode ray tube, or if the surface of the glass stem 2 is clean, the glass dielectric breakdown voltage (the lead along the stem glass surface) between the stem pins 3A and 3B and between the stem pins 3B and 3C is not problem. However, a temperature rise or deposition of dust or dirt caused by static charge degrades the dielectric breakdown voltage during operation, or an excess voltage over the dielectric breakdown voltage is often applied to the stem pins, so the dielectric breakdown voltage is not necessarily secured during operation.

To assure the necessary dielectric breakdown voltage, conventional technology uses a paste silicone resin of a room-temperature-curing type such as KE03490 made by Shin-Etsu Chemical Co. Ltd. and SE-9168 made by Toray Dow Corning Co., Ltd. That type of resin is hereinafter referred to simply as "RTV resin".

The RTV resin has basic electric characteristics, but it lacks flowability because of its paste property. As illustrated in FIG. 1B, the RTV resin 5 is squeezed out from the tube 6 between the stem pins before mounting the stem base 10 to the stem 2, then the stem base 10 is attached. Usually, the application of RTV resin 5 is manually carried out.

However, the RTV resin raises several problems in that it likely develops bubbles during application. A solvent existing in resin foams at a temperature range of from 80 to 120° C. under the heat generated during the aging stage for activating the cathode of the electron gun. Bubbles also occur during the insertion and withdrawal of connector of an instrument employed several times for inspection in the period between application of the RTV resin and the complete curing, (normally 7 days). Bubbles interfere with the perfect functioning of the electric characteristics of the resin and degrade the dielectric breakdown voltage and, in the worst case, discharge occurs between the causing damage to stem pins to damage the cathode ray tube.

OBJECTS AND SUMMARY OF THE INVENTION

The inventors solved these problems by providing the following inventions.

1. The first invention is electric insulator for inter-electrode insulation such as inter-stem insulation between pins for high voltage service in a cathode ray tube, which electric insulator comprises:

(1) An electric insulator comprising a clay-like silicone compound being formed to secure electrical insulation between stem pins or the like for high voltage service in a cathode ray tube.

(2) An electric insulator of (1), wherein the silicone compound has a volume resistivity ranging from $1\times10^{12}$ to $1\times10^{15}$ Ω•cm and a dielectric breakdown strength ranging from 10 to 30 KV/mm.

(3) An electric insulator of (1), wherein the clay-like insulator has a degree of plasticity giving a deformation ranging from 4/10 to 7/10 under a compression of 19 Kg-f.

(4) An electric insulator of (3), wherein a thickness of the formed shape is in a range of from 0.8 to 2.0 mm.

(5) An electric insulator of (1) through (4), wherein more than one throughhole are formed corresponding to at least a spacing of electrodes of electric equipment and accepting those electrodes penetrating therethrough.

(6) An electric insulator of (1) through (5), wherein throughholes corresponding to more than one stem pin including a high voltage stem pin in a cathode ray tube and to a tip of an exhaust pipe of the cathode ray tube are formed.

2. The second invention is a stem base having throughholes corresponding to more than one stem pin in a cathode ray tube and to a tip of exhaust pipe of the cathode ray tube, wherein the electric insulator is attached to the stem base while aligning these throughholes with the throughholes of the electric insulator described in (6) of 1.

3. The third invention is an inter-stem pin electric insulation device in a cathode ray tube, which comprises: a stem of a cathode ray tube; and the electric insulator described in 1 being attached to the external surface of the stem in a manner being penetrated by more than one stem pin including a high voltage stem pin which is protruding from the external surface of the stem and by a tip of an exhaust pipe of the cathode ray tube; a stem base provided with throughholes, a tip acceptor, and an acceptor for a high voltage stem pin, being placed and fixed in a manner that the stem pins penetrate the throughholes and that the stem base covers the tip at the tip acceptor and that the high voltage stem pin is isolated in the acceptor for the high voltage stem pin.

4. The fourth invention is a method for producing a cathode ray tube, which comprises: attaching an electron gun provided with more than one stem pin including a high voltage stem pin and with a stem introducing an exhaust pipe to a neck of a funnel which structures a tube body; welding the periphery of the neck edge with the periphery of the stem; forming a tip and closing it after evacuating the tube body through the exhaust pipe; attaching a clay-like electric insulator consisting of silicone compound which was formed aligning each of the throughholes for receiving the stem pins and the tip of the exhaust pipe; fitting the integrated stem base by penetrating the stem pins and the tip therethrough, and mounting and fixing the stem base to the stem.

Accordingly, an electric insulator of this invention suppresses the generation of bubbles described above or further eliminates the bubble formation, completely prevents the leak along the surface which is also described above, secures the electric insulation between high voltage stem pins or the like in a cathode ray tube, and does not damage the cathode ray tube.

Since the electric insulator of this invention is a clay-like formed shape, the work for insulating high voltage stem pins or the like from each other in a cathode ray tube is performed at a significantly improved efficiency.

In addition, the use of a stem base being attached with the electric insulator of this invention enhances the efficiency of the work for insulating high voltage stem pins or the like from each other.

Furthermore, the use of the stem base of this invention allows a mechanical mounting of an electric insulation device between high voltage stem pins or the like instead of conventional manual work. The mechanical mounting procedure leads to an automatic operation.

BRIEF DESCRIPTION OF THE DRAWINGS

FIG. 1 comprised of FIGS. 1A–1B, illustrates the method of electric insulation between stem pins including a high voltage stem pin of the related art.

FIG. 3 comprised of FIGS. 3A–3B, shows an electric insulator of the first embodiment in the present invention.

FIG. 4 comprised of FIGS. 4A, 4B, and 4C, illustrates the procedure for attaching the electric insulator of FIG. 3 of the second embodiment in the present invention onto the stem base.

FIG. 5 comprised of FIGS. 5A, 5B, and 5C, illustrates the structure of an electric insulation device of the present invention. The neck of a cathode ray tube which uses the electric insulator for more than one stem pin including a high voltage stem pin, is shown using the electrical insulator shown in FIG. 1 or the stem base shown in FIG. 4.

DETAILED DESCRIPTION OF THE PREFERRED EMBODIMENTS

An electric insulator of this invention, an electric insulation device using the electric insulator, and a method for producing a cathode ray tube using the electric insulator are described below referring to FIG. 3 through FIG. 5.

Figure 3A:
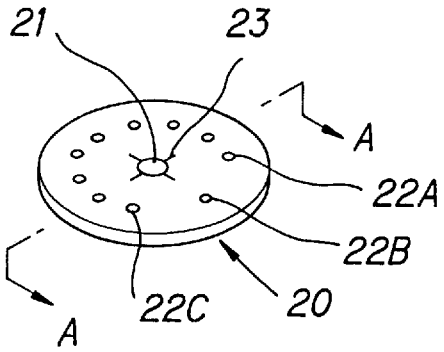
FIG. 3A gives a view of the electric insulator.
Figure 3B:
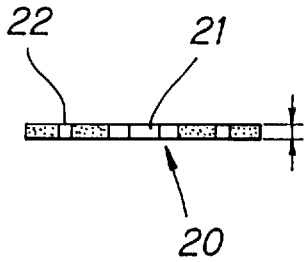
FIG. 3B shows the cross sectional view along A—A line of FIG. 3A.

FIG. 3 shows an electric insulator of this invention. FIG. 3A gives a view of the electric insulator, and FIG. 3B shows the cross sectional view along A—A line of FIG. 3A.

Figure 4A:
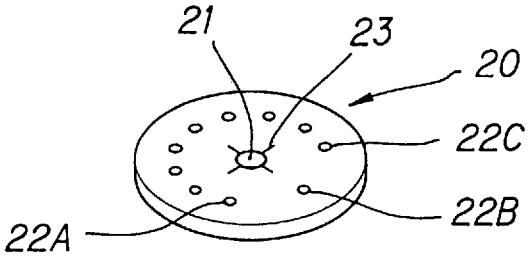
FIG. 4A gives a view of the electric insulator of FIG. 3.
Figure 4B:
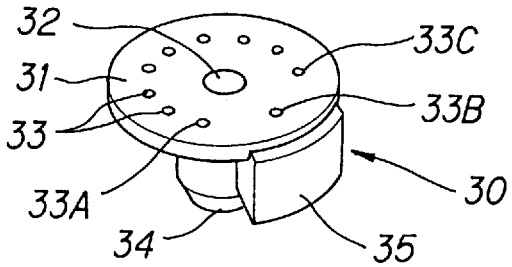
FIG. 4B gives a view of the electric insulator viewing from the stem side.
Figure 4C:
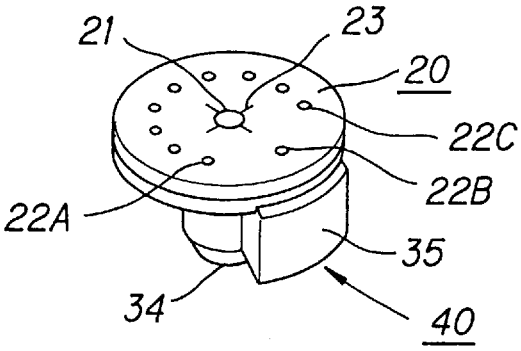
FIG. 4C is a stem base attached with an electric insulator of this invention.

FIG. 4 illustrates the procedure for attaching the electric insulator of FIG. 3 onto the stem base. FIG. 4A gives a view of the electric insulator of FIG. 3. FIG. 4B gives a view of the electric insulator viewing from the stem side. FIG. 4C is a stem base attached with an electric insulator of this invention.

Figure 5A:
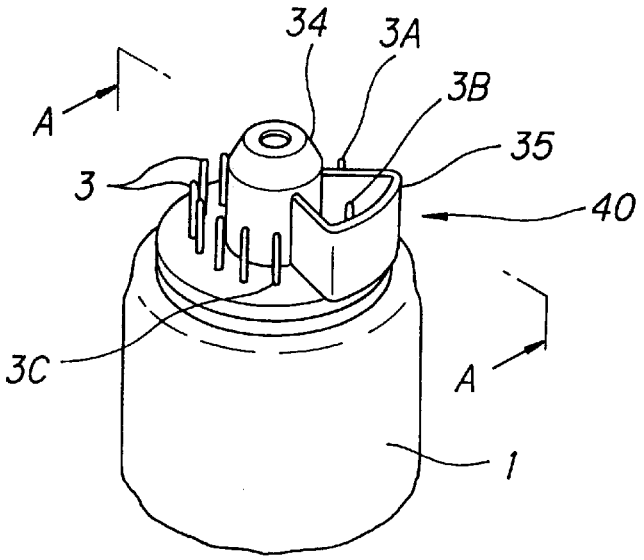
FIG. 5A gives a view of the device.
Figure 5B:
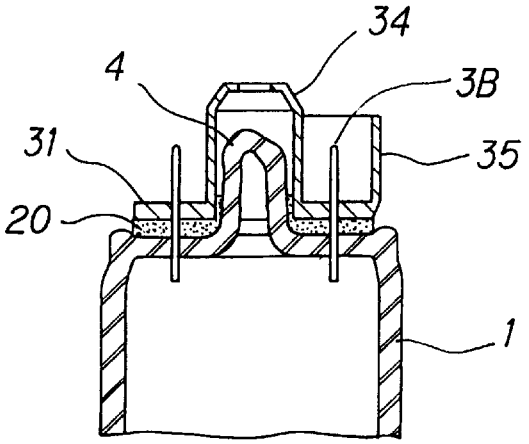
FIG. 5B shows the cross sectional view along A—A line in FIG. 5A.
Figure 5C:
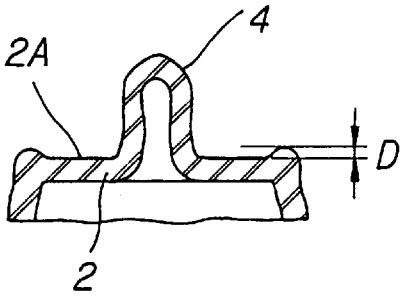
FIG. 5C shows a cross sectional view of the stem of neck structuring the cathode ray tube.

FIG. 5 illustrates the structure of an electric insulation device of this invention of the neck of cathode ray tube in which electric insulation between several stem pins including a high voltage stem pin is effected using the electrical insulator shown in FIG. 3 or the stem base shown in FIG. 4. FIG. 5A gives a view of the device. FIG. 5B shows the cross sectional view along A—A line in FIG. 5A. FIG. 5C shows a cross sectional view of the stem of neck structuring the cathode ray tube.

The components common to those in the figures of the related art, such as the electric device of the high voltage inter-stem pin in a cathode ray tube, have the same reference numbers with each other.

The following is the description of an electric insulator of the first embodiment in the present invention.

Referring to FIG. 3, the electric insulator 20 of this invention is formed to a disc having a thickness described below. The disc has a throughhole 21 for receiving a tip 4 at the center, and has throughholes 22A, 22B, 22C, etc. for receiving stem pins 3A, 3B, 3C, etc. including the high voltage stem pin 3B, at an each corresponding position.

Those throughholes may be formed at a time when the electric insulator 20 is punched from a large flat electric insulator using a forming die. The punching of the throughhole 21 for the tip is preferably carried out to have a cross slit 23 at the inner periphery of the throughhole 21. The electric insulator 20 with that type of slit 23 makes the insertion of tip 4 into the throughhole 21 easy and assures close contact of the outer periphery of the tip 4 with the inner periphery of the throughhole 21, which ensures the electric insulation.

The electric insulator 20 is a clay-like silicone compound. An example of that type of silicon compound uses "Putty-stock SMX-5999" made by Fuji Polymer Co. Ltd. as the basic component. By mixing a plasticizer to "Putty-stock SMX-5999", an electric insulator 20 having an adequate degree of plasticity is obtained.

FIG. 3 shows an example of the electric insulator 20 having the tip-throughhole 21, the pin-throughholes 22A, 22B, 22C, etc., and the slit 23. An electric insulator may otherwise simply be formed by punching a silicone compound to the outside diameter, and it is pressed to the tip 4 of the neck 1 and to the stem pins 3A, 3B, 3C, etc. to open these throughholes using a compression force, and then mounting it to the stem 2. Nevertheless, an electric insulator 20 which forms the throughholes shown in FIG. 3 in advance has an advantage that the tip 4 and the stem pins 3A, 3B, 3C, etc. are easily mounted without defecting the shape of the insulator.

The inventors carried out further extensive study and invented the stem base 40 with electric insulator, which is the second invention shown in FIG. 4C.

The stem base 40 with electric insulator is formed by attaching the electric insulator 20 shown in FIG. 4A (FIG. 3) to the stem base 30 to integrate them. The material of the stem base 30 may be a high insulation resin such as polycarbonate which is used in prior art.

As illustrated in FIG. 4B, the stem base 30 consists of: a tip-throughhole 32 which is opened at the center of the disc base plate 31 and which accepts the tip 4; pin-throughholes 33A, 33B, 33C, etc. including for the high voltage stem pin 3B, which are arranged along the peripheral pitch circle on the base plate 31 and which receive stem pins 3A, 3B, 3C, etc. at each corresponding position; and the tip acceptor 34 and acceptor for high voltage stem pin 35 locating on the side not facing the stem 2 of the base plate 31 to protect the tip 4 of the neck 1.

The stem base 30 has no skirt 14 which is seen on the stem base 10 of prior art. The skirt 14 may be formed at need. However, this invention uses a clay-like electric insulator 20 and is not the type of paste electric insulator 5, so there is not possibility of sagging of the insulator. Therefore, no skirt 14 is required in this invention. Moreover, elimination of the skirt 14 allows an easy production of the stem base 40 with the electric insulator, which stem base 40 is described below.

The following is the third embodiment of the present invention. The stem base 40 with electric insulator is formed by attaching the electric insulator 20 shown in FIG. 3 to the stem base 30 in advance while aligning each of the tip-throughhole 21, pin-throughholes 22A, 22B, 22C, etc. with the tip-throughhole 32, pin-throughholes 33A, 33B, 33C, etc. on the stem base 30, respectively. In other words, the stem base 40 with electric insulator has an integrated structure of the electric insulation 20 and the stem base 30.

When this type of stem base 40 with electric insulation is prepared in advance, the production line of cathode ray tubes at an assembly plant is shortened, and a special advantage is given in automatic mounting of the stem base 40 with electric insulation to the stem 2 as described before. Furthermore, even if the assembly is carried out manually, the workability should be significantly improved.

Accordingly, as illustrated in FIG. 5, the stem base 40 with electric insulation of this invention is attached to the evacuated neck 1 of a cathode ray tube under a compression force while aligning the tip-throughhole 32 with the tip-throughhole 21 on the mating electric insulator 20 and aligning each pin-throughholes 33A, 33B, 33C, etc. with the pin-throughholes 22A, 22B, 22C, etc. on the mating electric insulator 20, and with the stem pins 3A, 3B, 3C, etc., respectively, and while pressing down on the stem base 40 with electric insulation at the mating state to firmly contact the stem 2. The compression force is described later. In this manner, the inter-stem insulation is performed using the electric insulation device shown in FIG. 5A and FIG. 5B.

Figure 1A:
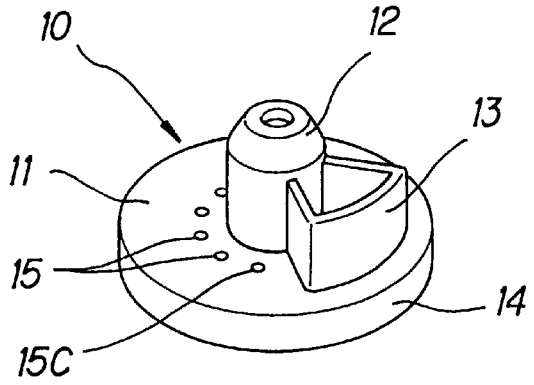
PRIOR ART FIG. 1A
FIG. 1A shows a stem base.
Figure 1B:
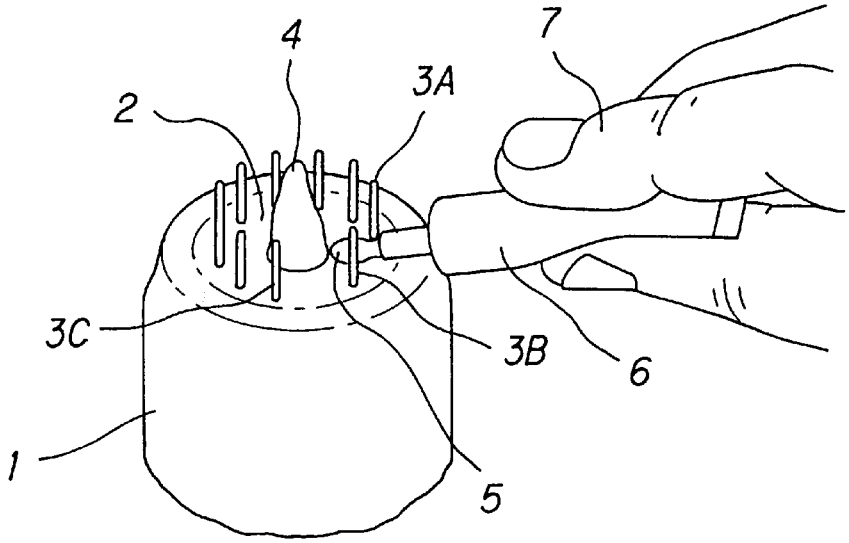
PRIOR ART FIG. 1B
FIG. 1B shows a neck of the cathode ray tube.
Figure 2A:
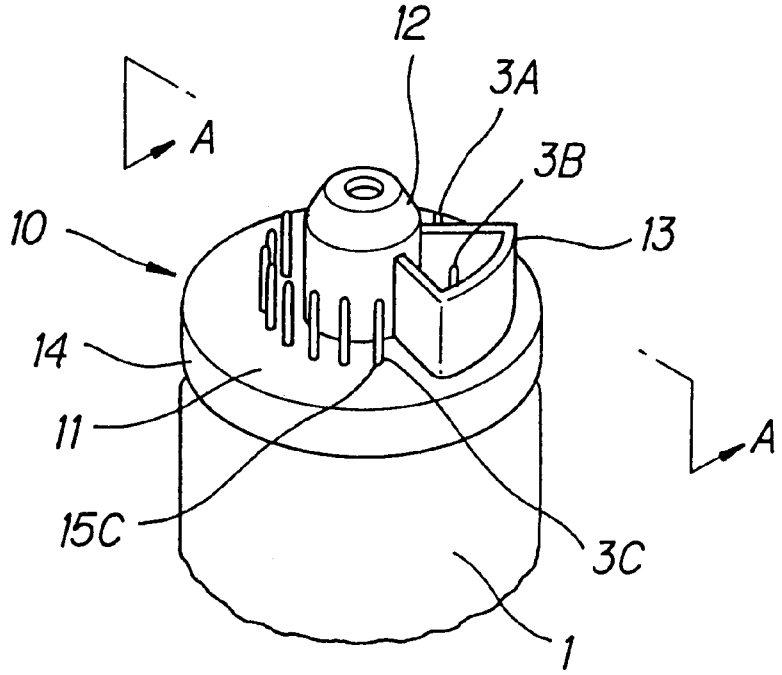
PRIOR ART FIG. 2A
FIG. 2A gives a view of the neck, and FIG. 2B gives the cross sectional view along A—A line in FIG. 2A.
Figure 2B:
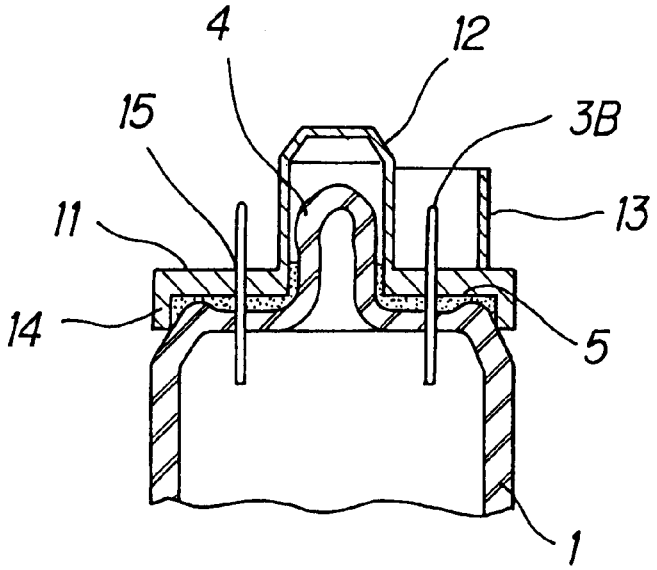
PRIOR ART FIG. 2B
FIG. 2 comprised of FIGS. 2A–2B, illustrates the neck of a cathode ray tube structured in accordance with the method of electrical insulation shown in FIG. 1.

Otherwise, the electric insulator 20 shown in FIG. 3 may be directly mounted on the stem pins, 3A, 3B, 3C, etc. and the tip 4 of the stem 2, and may further accept the stem base 30 as shown in FIG. 4B or the stem base 10 of prior art. However, if the stem base 40 with electric insulation of this invention shown in FIG. 2C is used, the mounting can be performed by a robot, which means that the production line of cathode ray tubes is automated.

Either electric insulator of this invention may be used to enhance the curing by the heat of cathode aging (80-120° C.) after mounting the electric insulator to the stem 2 at room temperature as described before. Since the electric insulator of this invention has a clay-like property, the amount of included solvent is quite small compared with the paste electric insulator of the prior art. As a result, the generation of bubbles in the curing stage due to the heat is minimized, and the required breakdown voltage is secured.

The following are experimental examples of the clay-like silicone compound electric insulator of this invention.

Experimental Example 1

The clay-like silicone compound used had the following properties. The experiments were conducted with various thickness, T, of the electric insulator 20 shown in FIG. 3B.

1. Volume resistivity: $1\times10^{14}$ Ω•cm
2. Dielectric breakdown strength: 25 KV/mm
3. Diameter of pin-throughhole: 0.97 mm
4. Degree of plasticity (Note 1): 1/2
5. Adhesive force (Note 2): 10 Kg•f
6. Thickness: 0.5, 0.8, 1.3, 1.8, 2.0, and 2.3 mm The clay-like silicone compound having the above listed properties was formed in a forming die to prepare the electric insulator 20 having the diameter of 22 mm, the pin-throughhole spacing of 4 mm corresponding to the spacings of stem pins 3A and 3B and of stem pins 3B and 3C. The electric insulator 20 was mounted to the stem 2 to measure the dielectric breakdown voltage between stem pins. The result is summarized in Table 1.

The term "degree of plasticity" means that the rate of shrinking of the sample thickness determined by sandwiching the clay-like silicone compound of 10mm square between glass plates and by applying a compression force of 10 Kg*f.

The term "adhesive force" means the adhesive force determined by sandwiching the sample between a glass plate and the stem base 30 shown in FIG. 4B and by applying a compression force of 10 Kg•f.

TABLE 1

| Thickness of electric insulator (mm) | 0.5 | 0.8 | 1.3 | 1.8 | 2.0 | 2.3 |
|---|---|---|---|---|---|---|
| Inter-pin dielectric breakdown voltage (KV) | 10 | 30 | 38 | 45 | 37 | 15 |

The figures of dielectric breakdown voltage are the average of 20 samples.

The depth, D, of the recess 2A on the stem 2 shown in FIG. 5C, which recess generated during the closing stage of the cathode ray tube, was normally in a range of from 0.3 to 0.5 mm. An electric insulator 20 having the thickness of 0.5 mm was of incapable of absorbing the recess 2A and degraded the dielectric breakdown voltage. When the thickness of the electric insulator 20 exceeds 2.0 mm, the thickness was too large and a loose mount occurred. In both cases, a preferable thickness of the electric insulator 20 was in a range of from 0.8 to 2.0 mm.

Experimental Example 2

The clay-like silicone compound used had the following properties. The experiments were conducted with various degree of plasticity of the electric insulator 20 shown in FIG. 3.

1. Volume resistivity: same as in Experimental example 1
2. Dielectric breakdown strength: same as in Experimental Example 1
3. Diameter of pin-throughhole: same as in Experimental Example 1
4. Degree of plasticity: 2/10, 4/10, 5/10, 6/10, 8/10
5. Adhesive force: same as in Experimental Example 1
6. Thickness: 1.8 mm The clay-like silicone compound having the above listed properties was formed in a forming die to prepare the electric insulator 20 having the diameter of 22 mm, and the pin-throughhole spacing of 4 mm corresponding to the spacings of stem pins 3A and 3B and of stem pins 3B and 3C. The dielectric electric insulator 20 was mounted to the stem 2 to measure the breakdown voltage between stem pins. The result is summarized in Table 2.

TABLE 2

| Degree of plasticity of electric insulator | 2/10 | 4/10 | 5/10 | 7/10 |
|---|---|---|---|---|
| Inter-pin dielectric breakdown voltage (KV) | 12 | 35 | 45 | 40 |

The experimental results showed a tendency that an electric insulation having a lower degree of plasticity (excess hardness) could not absorb the recess 2A of the stem 2 as observed in Experimental example 1, and likely left bubbles in the insulator, and degraded the breakdown voltage.

As described above, the electric insulator of this invention induces no degradation of dielectric breakdown voltage between stem pins nor fracture caused by unwelcome phenomena such as the generation of bubbles or irregular application of resin which are the disadvantages of conventional RTV resin. Consequently, the electric insulator of this invention does not suffer a discharge between pins and fully utilizes the electric characteristics inherent to silicon compound. In addition, the electric insulator of this invention can form the pin-throughholes and tip-throughhole simultaneously by punching the form in a forming die, which allows the mass-production of electric insulators which are easy to mount on stems.

Furthermore, the stem base with the electric insulator of this invention is easily handled manually, as described before, and is mounted by a mechanical means, and allows an automatic mounting. Accordingly, this invention provides various effects as described above.

The detailed description given above used a cathode ray tube as an example. This invention, however, is not limited to the cathode ray tube, and naturally deals with the electric insulation between electrodes of electric equipment such as between electrodes of a high voltage transformer actuating under a high voltage.

What is claimed is:

1. An electric insulator comprising a deformable silicon compound which is formed to electrically insulate stem pins of a cathode ray tube, the insulator comprising:

(a) a first plurality of pin throughholes corresponding to a plurality of stem pins, including a high voltage stem pin, of the cathode ray tube, said first plurality of throughholes being formed in said insulator for receiving therethrough said stem pins of said cathode ray tube; and (b) a first exhaust pipe throughhole corresponding to a tip of an exhaust pipe of the cathode ray tube formed in said insulator for receiving therethrough said exhaust pipe of said cathode ray tube;

wherein, the first exhaust pipe throughhole of said insulator corresponding to said exhaust tip has a diameter less than a diameter of said exhaust tip.

2. An electric insulator of claim 1, wherein the silicone compound has a volume resistivity ranging substantially from $1\times10^{12}$ to $1\times10^{15}$ Ω*cm and a dielectric breakdown strength ranging substantially from 10 to 30 KV/mm.

3. An electric insulator of claim 1, wherein the insulator has a degree of plasticity giving a deformation ranging substantially from 4/10 to 7/10 under a compression of about 19 Kg*f.

4. An electric insulator of claim 3, wherein a thickness of the electric insulator is in a range substantially of from 0.8 to 2.0 mm.

5. A stem base having a second plurality of pin througholes corresponding to the plurality of stem pins in a cathode ray tube and a second exhaust pipe throughhole corresponding to said tip of the exhaust pipe of the cathode ray tube, wherein the electric insulator as claimed in any of claims 1 through 4 is attached to the stem base while aligning the first and second pluralities of pin througholes and the first and second exhaust pipe througholes.

6. An insulating assembly for a cathode ray tube comprising:

(a) a cathode ray tube stembase comprising;

(1) a plurality of stem pins, including a high voltage stem pin, and (2) an exhaust pipe having a first diameter; and (b) an electric insulator made of a deformable silicon compound which is formed to electrically insulate said stem pins of said cathode ray tube, the insulator comprising;

(1) a first plurality of pin throughholes defined in said insulator, said plurality of stem pins of said cathode ray tube being inserted through said first plurality of pin throughholes, and (2) a first exhaust pipe throughhole defined in said insulator, said exhaust pipe of said cathode ray tube being inserted through said first exhaust pipe throughhole;

wherein, the first exhaust pipe throughhole of said insulator has a second diameter which is less than said first diameter of said exhaust tip.

7. An insulating assembly as claimed in claim 6, wherein said stem base further comprise a second plurality of pin througholes corresponding to the plurality of stem pins in the cathode ray tube and a second exhaust pipe throughhole corresponding to said tip of the exhaust pipe of the cathode ray tube, wherein the throughholes of said electric insulator are aligned with said throughholes of said stem base and said plurality of stem pins and said exhaust pipe are inserted through said second plurality of pin throughholes and said second exhaust pipe throughhole of said stem base, respectively.

8. An insulating assembly as claimed in claim 7, wherein said stem pins and said exhaust pipe pass through said throughholes of said stem base before passing through said throughholes of said insulator.

* * * * *